US007603873B2

(12) United States Patent
Tonin

(10) Patent No.: US 7,603,873 B2
(45) Date of Patent: Oct. 20, 2009

(54) ENBLOC AIR CONDITIONER

(75) Inventor: Maurizio Enrico Tonin, S. Vito Di Leguzzano (IT)

(73) Assignee: Xiang S.p.A., San Vito Di Leguzzano (Vicenza) (IT)

( * ) Notice: Subject to any disclaimer, the term of this patent is extended or adjusted under 35 U.S.C. 154(b) by 246 days.

(21) Appl. No.: 10/518,506

(22) PCT Filed: Jul. 9, 2003

(86) PCT No.: PCT/EP03/07394

§ 371 (c)(1),
(2), (4) Date: Dec. 20, 2004

(87) PCT Pub. No.: WO2004/008033

PCT Pub. Date: Jan. 22, 2004

(65) Prior Publication Data

US 2005/0160753 A1 Jul. 28, 2005

(30) Foreign Application Priority Data

Jul. 10, 2002 (IT) ..... VI02A0154

(51) Int. Cl.
*B60H 1/32* (2006.01)

(52) U.S. Cl. ..... 62/262; 62/426

(58) Field of Classification Search ..... 62/262, 62/263, 426, 427, 428, 285, 291, 429
See application file for complete search history.

(56) References Cited

U.S. PATENT DOCUMENTS

| | | | | |
|---|---|---|---|---|
| 2,917,905 | A | 12/1959 | McGrath et al. | |
| 3,279,209 | A * | 10/1966 | Laing | 62/426 |
| 3,783,637 | A * | 1/1974 | Woods | 62/427 |
| 4,067,204 | A * | 1/1978 | Riello | 62/262 |
| 4,102,148 | A * | 7/1978 | Matthews et al. | 62/77 |
| 4,637,223 | A | 1/1987 | Hosoya et al. | |
| 5,551,508 | A | 9/1996 | Lim et al. | |
| 6,134,904 | A * | 10/2000 | Jianxing | 62/296 |
| 6,511,287 | B2 * | 1/2003 | Kim | 415/204 |
| 6,692,223 | B2 * | 2/2004 | Ikeda et al. | 415/53.1 |
| 6,782,707 | B2 * | 8/2004 | Shindo et al. | 62/264 |
| 2003/0167786 | A1 * | 9/2003 | Nakagawa et al. | 62/285 |

FOREIGN PATENT DOCUMENTS

| | | |
|---|---|---|
| FR | 1303675 | 1/1963 |
| FR | 2 349 105 | 11/1977 |
| JP | 61213529 | 9/1986 |
| JP | 02230032 | 9/1990 |
| JP | 08219541 | 8/1996 |
| JP | 2001141298 | 5/2001 |
| WO | 01/07837 | 2/2001 |

* cited by examiner

*Primary Examiner*—Melvin Jones

(57) ABSTRACT

An enbloc air conditioner has a condenser unit and an evaporator unit aligned one behind the other on opposite sides of a plane transverse to the air flow path.

7 Claims, 5 Drawing Sheets

ENBLOC AIR CONDITIONER

The present invention relates to an enbloc air conditioner.

It is well known that air conditioners are used to obtain optimal comfort conditions in working or dwelling rooms by controlling temperature and/or humidity.

According to a first design, conditioners are provided with two separated units, more particularly a condenser unit arranged outside and connected by refrigerant conveying tubes to an evaporator unit arranged in the room to be conditioned.

A drawback of the above mentioned installations is the need of providing ducts for the refrigerant conveying tubes and cables for the electric power.

Another drawback is that the outside arrangement of the condenser unit generally involves aesthetic problems, especially in buildings of the old town centers.

In order to remove such drawbacks enbloc conditioners are now available combining the condenser unit and the evaporator unit in a single structure which is generally installed in the wall inside the room to be conditioned.

More particularly the condenser unit is in communication with outside through inlet and outlet for outside air made in the building walls or in the window panes, while the evaporator unit is provided with intake and delivery ways for the air to be treated which is withdrawn from the room and then introduced again in the same room after the treatment.

To this purpose several designs are available, one of which for instance having the condenser unit and the evaporator unit arranged in the same container juxtaposed one aside the other.

According to other designs the condenser unit and the evaporator unit are still arranged in a single container but juxtaposed one above the other.

These enbloc conditioners in both above mentioned designs do not have any environmental impact to the outside excepting the air inlet and outlet of the condenser unit.

Said conditioners however occupy more space in the room where they are installed, just because both condenser and evaporator units are arranged inside, and such overall dimensions may not be acceptable in some situations, for example in small volume rooms such as little flats or studios.

Another problem of the enbloc conditioners is the arrangement in the room to be conditioned of both condenser and evaporator units with corresponding fans involving an increase of noise. In some cases such a noise may not be acceptable especially when the conditioner is to be installed for instance in bedrooms.

SUMMARY OF THE INVENTION

The present invention aims at overcoming said limitations and drawbacks.

More particularly an object of the invention is to provide an enbloc air conditioner having smaller size relative to equivalent enbloc conditioners of the prior art with the same output.

Another object of the invention is to provide a conditioner emitting lower noise relative to equivalent enbloc conditioners of the prior art.

The foregoing objects are attained by an enbloc air conditioner that according to the main claim comprises:

a condenser unit crossed by an outside air flow to the room to be conditioned between at least an inlet and at least an outlet;

an evaporator unit crossed by a flow of air internal to the room to be conditioned between at least an intake and at least a delivery way, and wherein said condenser unit and said evaporator unit are arranged in a single container, in said container a first part is defined wherein said evaporator unit is arranged and a second part in which said condenser unit is arranged, only said first part of said container in which said evaporator unit is arranged, projecting inside said room to be conditioned, said parts are aligned one behind the other according to an axis parallel to the direction of the inlet and the outlet of said external air flow, through said at least one inlet and one outlet of said condenser unit, said inlet and said outlet being placed in a substantially horizontal plane and said inlet and outlet comprising two holes, the perimetral external surface of said second part of said container being suited to be coupled to the surfaces of opening made in a wall of said room to be conditioned, said evaporator unit being provided with an inclined air delivery opening pointing downwards.

According to the invention the container defines a first part where the evaporator unit is arranged and a second part where the condenser unit is arranged, wherein only the first part of the container where the evaporator unit is arranged is projecting inside the room while the second part where the condenser unit is arranged is built in into the wall.

According to the invention the container defines a first part where the evaporator unit is arranged and a second part where the condenser unit is arranged, wherein only the first part of the container where the evaporator unit is arranged is projecting inside the room while the second part where the condenser unit is arranged is built in into the wall.

Advantageously the enbloc conditioner of the invention when compared with equivalent conditioners of the prior art with equal output is less bulky and has a better aesthetic look for the room where it is installed relative to equivalent conditioners of the prior art.

Still advantageously the reduction of dimensions enhances installation of enbloc conditioners even in rooms of small size.

In a further advantageous way the possibility to arrange the condenser unit in the wall thickness, allows to obtain a deadening effect reducing noise in the room to be conditioned.

BRIEF DESCRIPTION OF THE DRAWINGS

The foregoing objects and advantages will be better understood by the description of a preferred embodiment of the invention with reference to the accompanying sheets of drawings in which.

DESCRIPTION OF THE INVENTION

Figure 1:
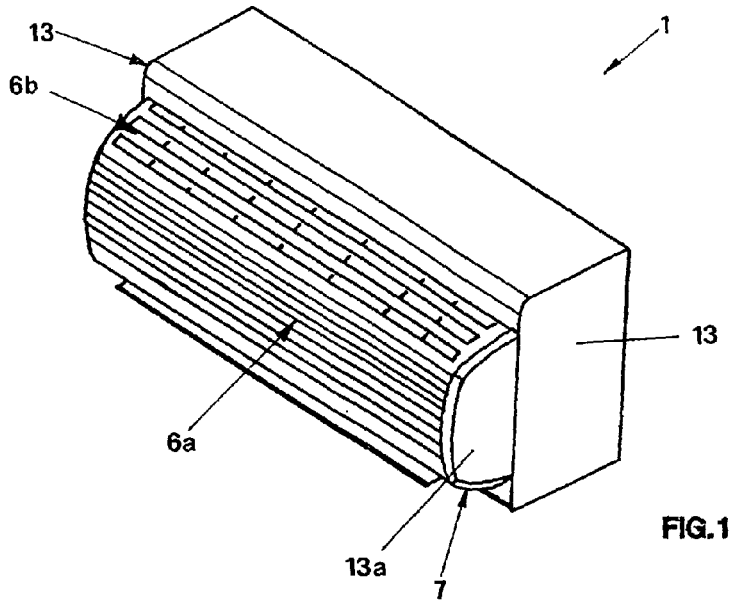
FIG. 1 is an isometric front view of the conditioner of the invention.
Figure 2:
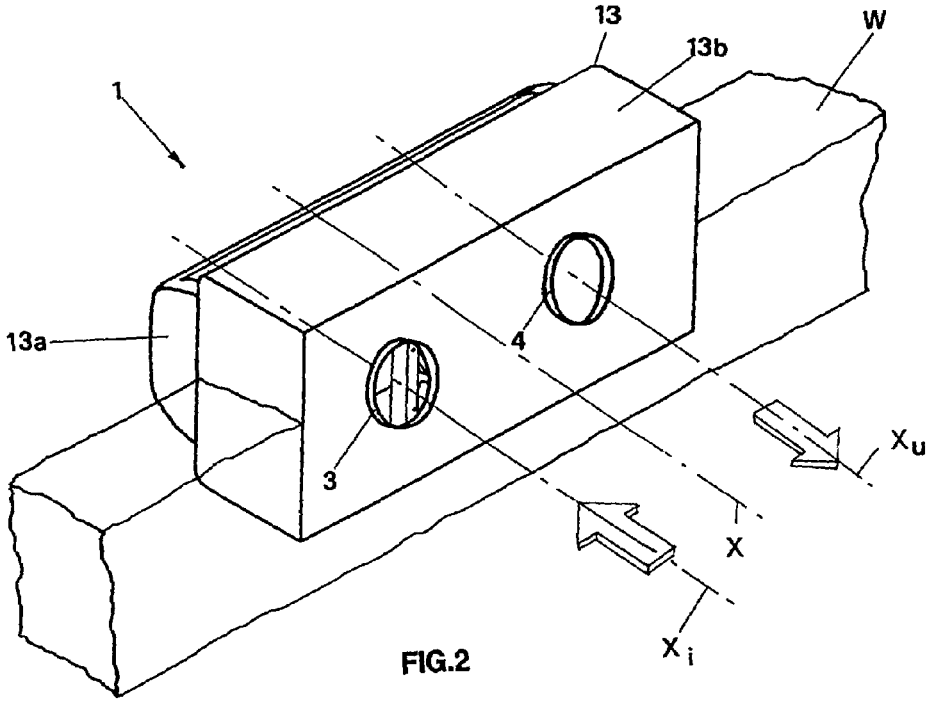
FIG. 2 is an isometric rear view of the conditioner of the invention.
Figure 3:
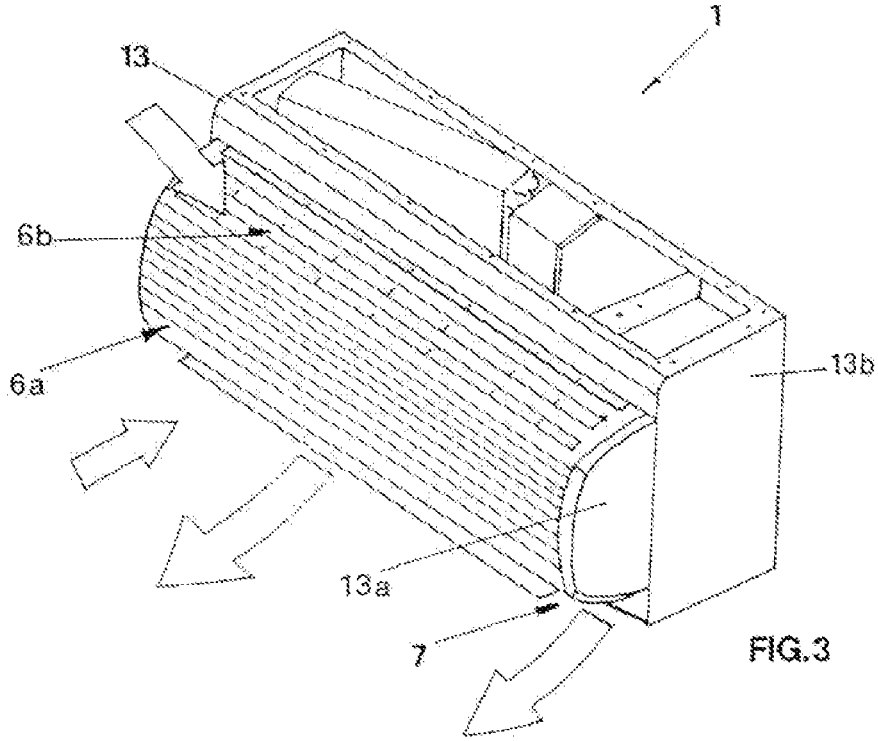
FIG. 3 is an inner view of the conditioner of FIG. 1.

The air conditioner of the invention is shown in the isometric views of FIGS. 1 to 5 where it is generally indicated with 1.

One can see that the conditioner comprises a condenser unit generally indicated with 2, crossed by a flow of outside air between an inlet 3 and an outlet 4 and an evaporator unit generally indicated with numeral 5, crossed by a flow of air internal to the room to be conditioned between intakes 6*a*, 6*b* and a delivery way 7.

More particularly the inlet 3 and outlet 4 consist of holes of big diameter, preferably not lower than 160 mm.

Both the condenser unit 2 and the evaporator unit 5 are of a kind known per se wherein:

the condenser unit 2 comprises: a compressor 8 for the refrigerant, a fan 9 withdrawing external air through the inlet 3 and a condenser bank 10 crossed by the air conveyed by the fan 9 before passing through the outlet 4;

the evaporator unit 5 comprises: a fan 11 withdrawing internal air through the front intake 6*a* and top intake 6*b* and an evaporator bank 12 arranged upstream on the suction side of fan 11, cooling air before it goes out through the delivery way 7 directed downwards.

The compressor 8, the condenser bank 10 and the evaporator bank 12 are hydraulically connected to each other to refrigerant exchange tubes and additional means according to the prior art and moreover the compressor 8 and the fans 9 and 11 are electrically connected to the electricity mains.

According to the invention, both the condenser unit 2 and the evaporator unit 5 are arranged in a single container 13 in which they are aligned one behind the other according to an axis X parallel to the directions of inlet Xi and outlet Xu of the outside air flow through the condenser unit 2.

More particularly in the container 13 a first part 13*a* is defined in which the evaporator unit 5 is arranged and a second part 13*b* in which the condenser unit 2 is arranged.

Figure 4:
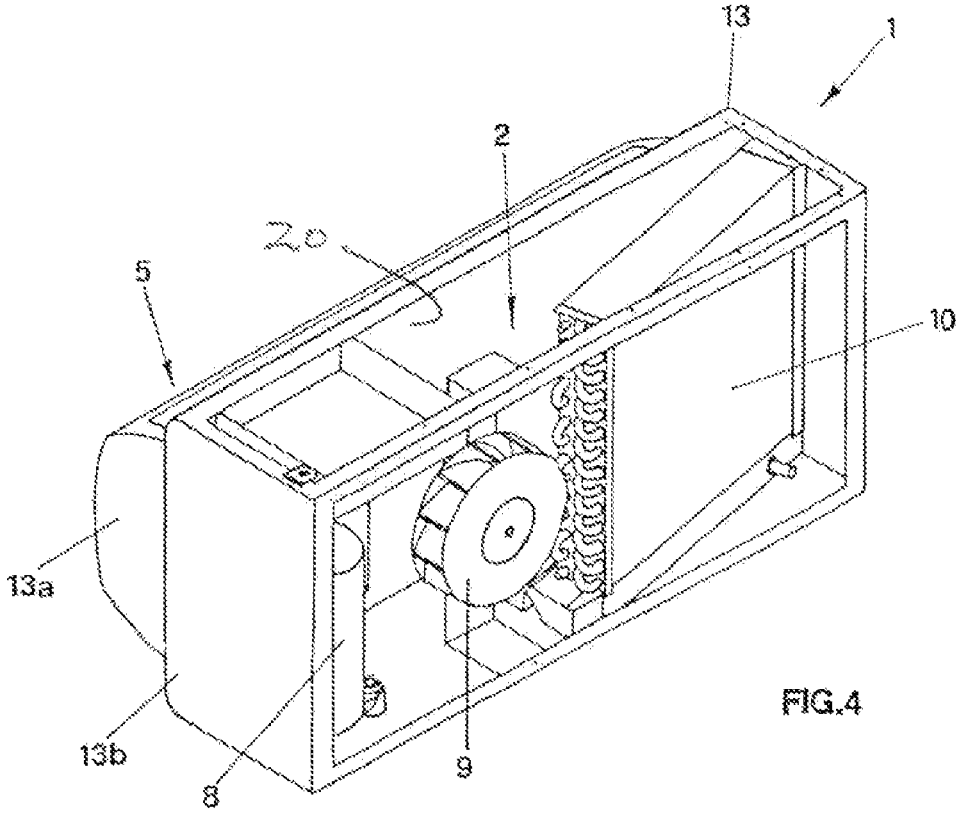
FIG. 4 is an inner view of the conditioner of FIG. 2.
Figure 5A:
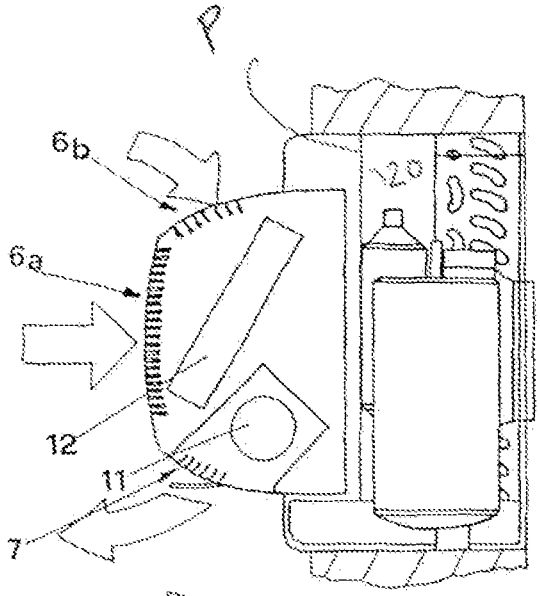
FIG. 5*a* is a cross sectional view of the conditioner of the invention in the installed condition.

The evaporator unit 5 and the condenser unit 2 are separately housed within their respective first and second parts of the housing. Wall 20, lying in a single plane P, perpendicular to the axis X, extends completely across the housing, as shown in FIGS. 4, 5, and 5*a*.

Figure 5:
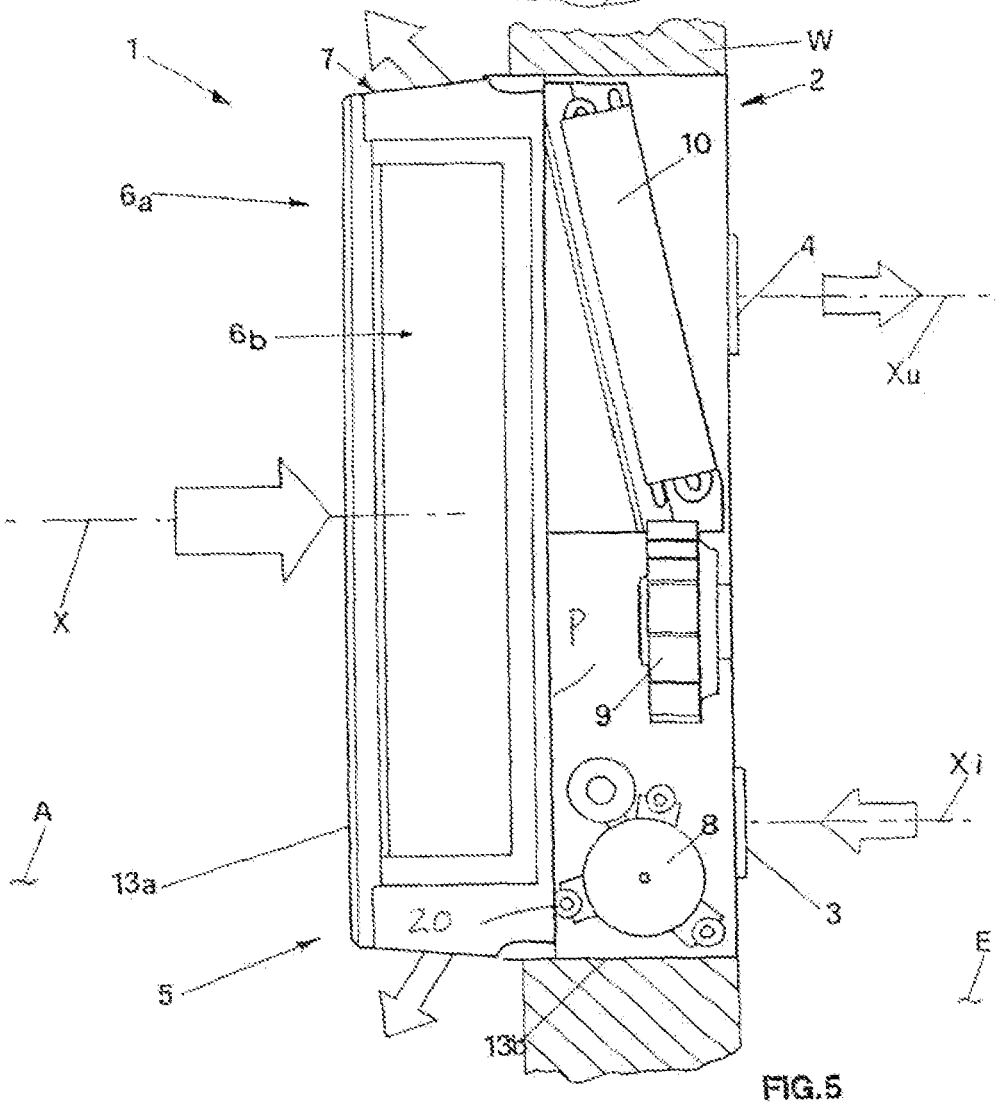
FIG. 5 is a longitudinal section of the conditioner of the invention in the installed condition.
Figure 6:
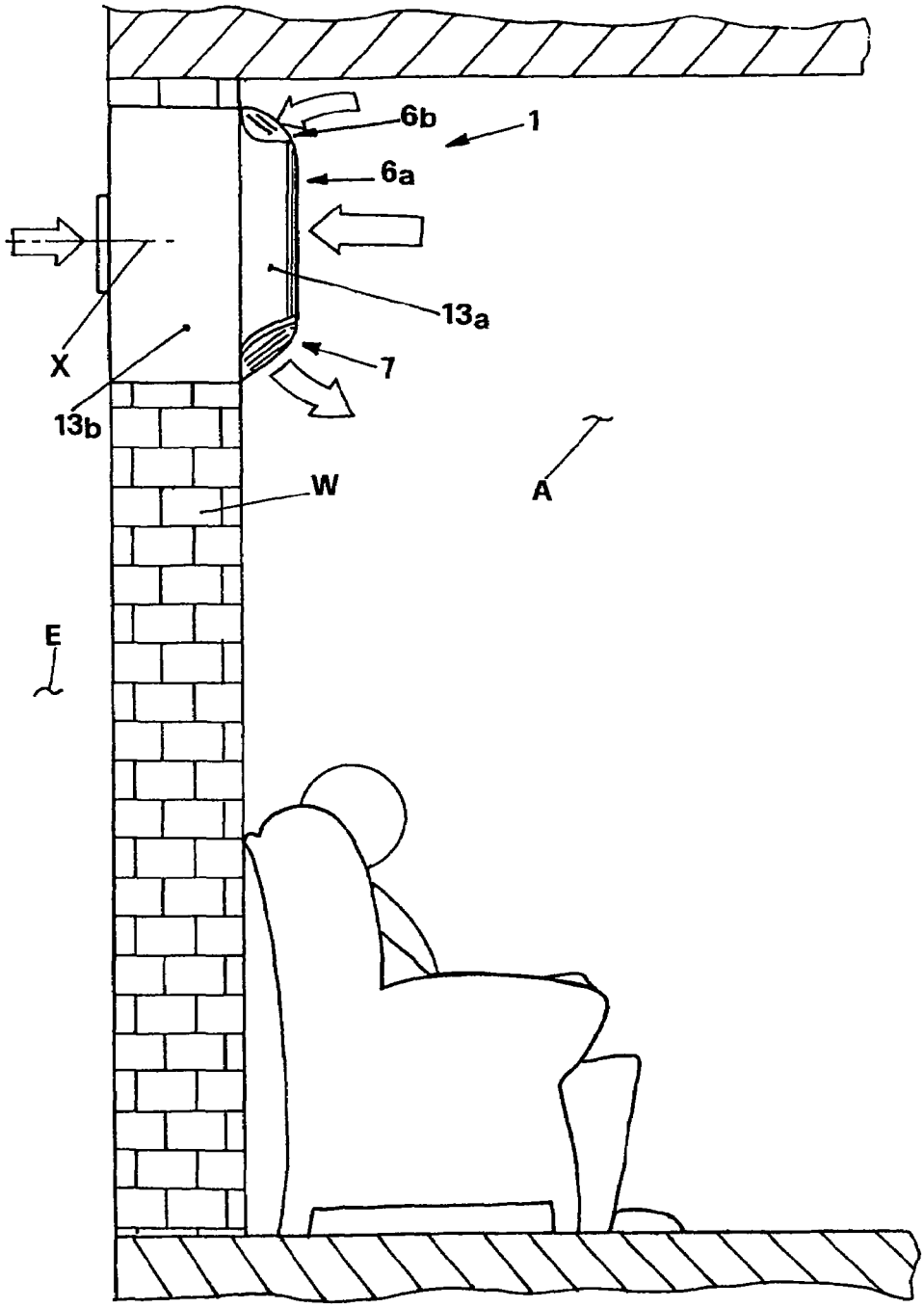
FIG. 6 shows an installation form of the conditioner of the invention.

On installation the second part 13*b* as shown in greater detail in FIGS. 5 and 6, is arranged in a proper opening made in the wall W of the room with the inlet 3 and outlet 4 facing the outside E, while the first part 13*a* of the same container 13 is facing the internal room A to be conditioned.

In such a way the space occupied by the conditioner inside the room A to be conditioned is limited only to the projection of the first part 13*a* to the advantage of space occupation and aesthetic look, particularly felt in rooms of small size such as for instance the rooms of small flats or studios.

Moreover the arrangement of the second part 13*b* comprising the entire condenser unit 2 in the thickness of the wall W, absorbs the noise of the fan 9 that consequently is not transmitted inside the room A.

In this way in the room A to be conditioned the same noise level is obtained, that is found when using traditional conditioners not of the enbloc type provided with a separate condenser unit arranged outside.

An installation form of the conditioner of the invention is shown in FIG. 6 where one can see that the second part 13*b* of the container 13 is arranged in the top and within the thickness of the wall W while only the first part 13*a* corresponding to the evaporator unit projects inside the room A. One can see that the intake 6*a* and 6*b* are facing the front part and the ceiling of the room respectively, and the delivery way 7 is inclined facing downwards.

It is anyway clear that such an arrangement is only an illustrative one as the user may choose other configurations more suitable for his requirements.

Figure 7:
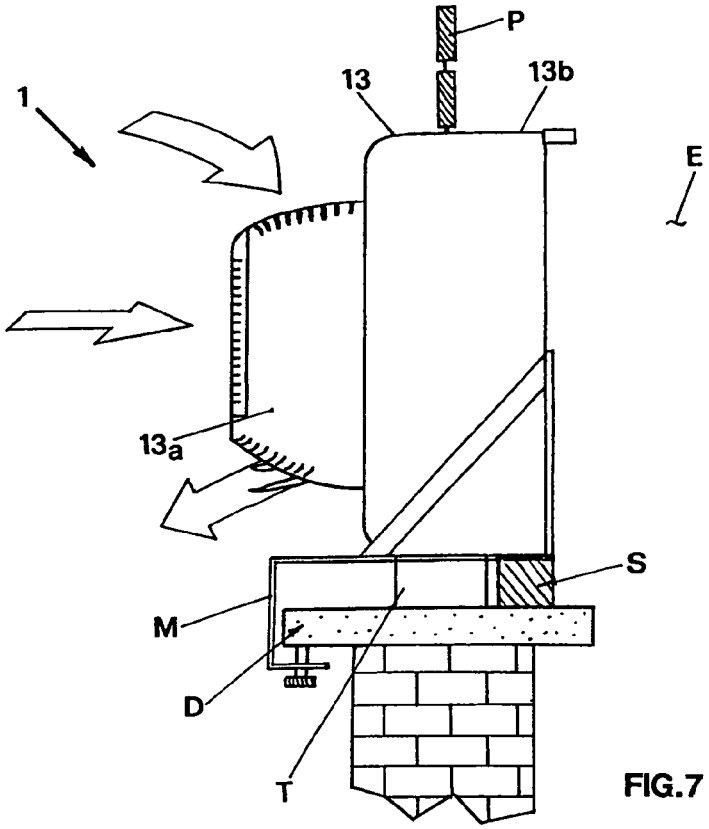
FIGS. 7 and 8 show another installation form of the conditioner of the invention.
Figure 8:
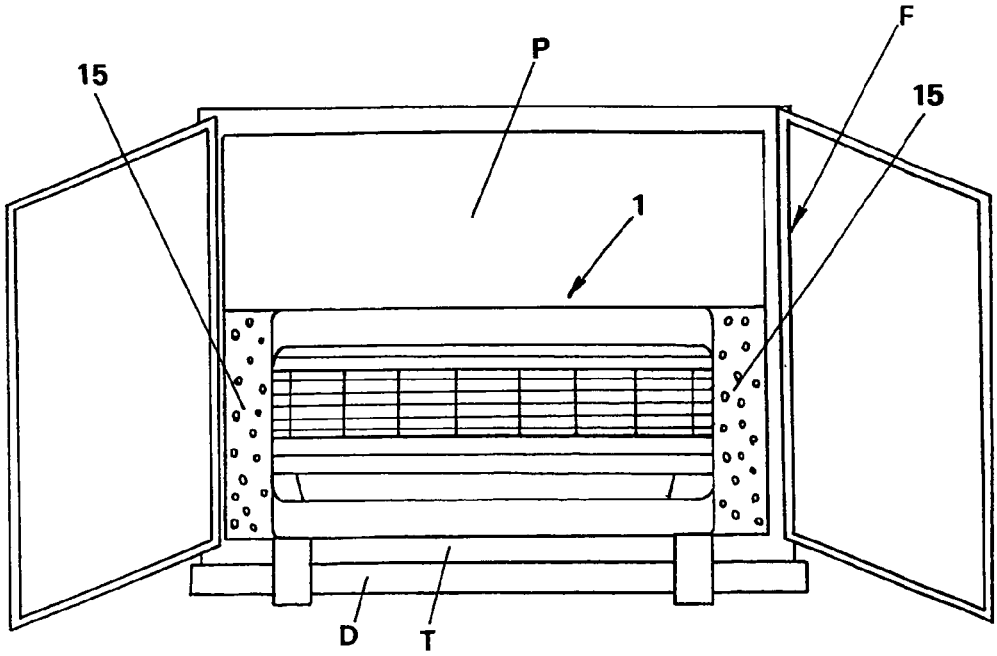

Another installation form of the conditioner of the invention is shown in FIG. 7 which is useful as removable application especially by night when the blinds are closed.

Indeed in this installation form one can see that the conditioner generally indicated with 1, is arranged on the windowsill D of a window F where the second part 13*b* of the container 13 where the condenser unit 2 is arranged, is facing the outside E relative to the descent plane of the rolling shutter P.

A suitable insulation 15 is arranged at the conditioner sides to fit its size to the dimensions of the window F, while a spacer S is arranged on the windowsill D to make the conditioner flush with the window frame T, the conditioner being fixed to the windowsill D, through one or more clamps M.

On the basis of the foregoing description one can see that the conditioner of the invention attains all the intended objects.

More particularly the object is attained to provide an enbloc conditioner requiring less space inside the room where it is installed in comparison with equivalent enbloc conditioners of the prior art.

The further object is also attained to provide a conditioner having a lower environmental impact to the outside relative to the conditioners of the split system because the condenser unit is fully arranged inside the wall in which the conditioner is installed.

It is clear that the conditioner of the invention may be made of any shape and with different output power according to the requirements.

Possible constructional variations that should be made even neither described nor shown in the figures, when falling within the scope of the appended claims, should be considered all protected by the present invention.

The invention claimed is:

1. An enbloc air conditioner for cooling a room of a building having an outside wall with an inside surface inside the room and an outside surface outside the building and a through opening formed with internal surfaces coupled between the inside and the outside surfaces, said air conditioner comprising:

a housing forming a single container in communication with the room, the housing having a first part and a second part disposed one behind the other and an outer perimidal wall sized to fit within the through opening in the building wall;

a condenser unit crossed by a flow of air external to the room to be conditioned between at least an inlet and at least an outlet arranged in the first part of the housing;

an evaporator unit crossed by a flow of air internal to the room to be conditioned between at least an intake and at least a delivery way arranged in the second part of the housing a plate secured in the housing extending completely across the housing forming a separating wall extending to the perimedial wall between the condenser unit and the evaporator unit, said wall lying in a single plane perpendicular to the to the axis of said inlet and outlet for separating and isolating the condenser unit from the evaporator unit and interposing the evaporator between the condenser and the room; and wherein only said second part of said housing containing the evaporator unit projecting inside said room, and said inlet and said outlet each being formed of respective holes, the perimetral external surface of said first part of said container being suited to be coupled to the internal surfaces of the through opening in the wall of said room to be conditioned, said evaporator unit being provided with an inclined air delivery opening pointing downwards.

2. The enbloc air conditioner according to claim 1 wherein said holes are substantially circular having a diameter of at least 160 mm.

3. The enbloc air conditioner according to claim 1 wherein at least one intake of said evaporator unit comprises a first intake lying generally in a vertical plane and a second intake above and inclined with respect to the first intake.

4. The enbloc air conditioner according to claim 1 wherein said condenser unit comprises at least a refrigerant compressor, at least a condenser bank and at least a fan arranged upstream said condenser bank.

5. The enbloc air conditioner (1) according to claim 1 wherein said evaporator unit comprises at least an evaporator bank and at least a fan arranged upstream said evaporator bank.

6. An air conditioner installation comprising:

an enbloc air conditioner including a housing formed with first and second compartments and a separating wall between said first and second compartments;

a condenser unit enclosed in a first compartment of said housing crossed by a flow of air external to the room to be conditioned between at least an inlet and at least an outlet;

an evaporator unit enclosed in a second compartment of said housing crossed by a flow of air internal to the room to be conditioned between at least an intake and at least a delivery way, said second compartment and the separating wall isolating the condenser unit from the room, said first and second parts being aligned one behind the other according to an axis parallel to the direction of the inlet and the outlet of said external air flow through said at least one inlet and at least one outlet of said condenser unit and on opposite sides of the separating wall lying in a plane perpendicular to said direction, said inlet and said outlet being placed in a substantially horizontal plane and said inlet and outlet consisting of two holes, a wall of said room to be conditioned facing the outside and having an opening suited to house said enbloc air conditioner, wherein said opening of said wall is placed substantially in the top of said wall, said first part of said container projecting inside said room, the perimetral external surface of said second part of said container being suited to be coupled with the surfaces of an opening made in a wall of said room and delivery openings of said delivery way being inclined downwards.

7. An air conditioner adapted to be located in a through hole having a central axis, the hole formed in a building wall extending between a room inside the building to outside the building comprising:

a housing forming a channel having a central axis aligned with the axis of the hole, said housing having opposite ends and sidewalls, the housing being positioned in use in the hole with the ends positioned one each in the room and outside the building along said axis;

a separating wall disposed in and extending completely across the channel between the sidewalls forming first and second compartments within the housing, said wall lying in a plane entirely perpendicular to the central axis of the housing;

a condenser unit disposed in the channel in the first compartment near the outside end of the housing;

an evaporator unit disposed in the channel in the second compartment near the inside end of the housing, the second compartment and the wall thereby isolating the condenser compartment from the room;

the condenser unit and the evaporator unit being arranged in the respective compartments of the housing in alignment along the channel one completely behind the other and on opposite sides of the wall separating the first and second compartments, the compartment of the housing near the inside the room having an inlet into the room for air and a pair of outlets into the room for circulating air to be cooled therethrough, the inlet lying in a plane parallel to the plane separating the evaporator and condenser, and each outlet lying in a corresponding plane, one above the inlet and one below the inlet, each corresponding plane lying at an angle with respect to the inlet, and the portion of the housing outside the building having an inlet and an outlet for circulating heated air from the condenser to outside the housing, said inlet and said outlet being placed in a substantially vertical plane.

* * * * *